US007048811B2

(12) United States Patent
Ohgami et al.

(10) Patent No.: US 7,048,811 B2
(45) Date of Patent: May 23, 2006

(54) ELECTRIC RESISTANCE-WELDED STEEL PIPE FOR HOLLOW STABILIZER

(75) Inventors: Masahiro Ohgami, Hikari (JP); Tetsuya Magatani, Tokyo (JP); Naoki Takasugi, Hikari (JP); Osamu Takeda, Hikari (JP)

(73) Assignee: Nippon Steel Corporation, Tokyo (JP)

( * ) Notice: Subject to any disclaimer, the term of this patent is extended or adjusted under 35 U.S.C. 154(b) by 213 days.

(21) Appl. No.: 10/471,135

(22) PCT Filed: Mar. 4, 2002

(86) PCT No.: PCT/JP02/01973

§ 371 (c)(1),
(2), (4) Date: Sep. 5, 2003

(87) PCT Pub. No.: WO02/070767

PCT Pub. Date: Sep. 12, 2002

(65) Prior Publication Data

US 2004/0131876 A1 Jul. 8, 2004

(30) Foreign Application Priority Data

Mar. 7, 2001 (JP) ..... 2001-063140

(51) Int. Cl.
*C22C 38/06* (2006.01)
*C22C 38/22* (2006.01)
*C22C 38/28* (2006.01)

(52) U.S. Cl. ..... 148/330; 148/334; 420/110; 420/106

(58) Field of Classification Search ..... 148/320, 148/334, 330; 420/110, 106
See application file for complete search history.

(56) References Cited

U.S. PATENT DOCUMENTS

| | | | | |
|---|---|---|---|---|
| 5,192,376 | A * | 3/1993 | Tanabe et al. | 148/520 |
| 6,290,789 | B1 * | 9/2001 | Toyooka et al. | 148/593 |
| 6,331,216 | B1 * | 12/2001 | Toyooka et al. | 148/320 |

FOREIGN PATENT DOCUMENTS

| | | | |
|---|---|---|---|
| JP | 57-126917 | A | 8/1982 |
| JP | 58-123858 | | 7/1983 |
| JP | 60-215719 | * | 10/1985 |
| JP | B-61-45688 | | 10/1986 |
| JP | B-1-58264 | | 12/1989 |
| JP | 5-51692 | | 3/1993 |
| JP | 5-302119 | A | 11/1993 |
| JP | 6-93339 | A | 4/1994 |
| JP | 6-172859 | | 6/1994 |
| JP | 6-220536 | | 8/1994 |
| JP | 6-220536 | A | 8/1994 |
| JP | 7-89325 | A | 4/1995 |
| JP | 2000-8123 | A | 1/2000 |
| JP | 2000-119750 | | 4/2000 |
| JP | 2000-178688 | | 6/2000 |
| WO | WO 98/49362 | A1 | 11/1998 |

OTHER PUBLICATIONS

Patent Abstracts of Japan, JP 57126917, published Aug. 6, 1982.
Patent Abstracts of Japan, JP 2000084614, published Mar. 28, 2000.

* cited by examiner

*Primary Examiner*—Deborah Yee
(74) *Attorney, Agent, or Firm*—Kenyon & Kenyon LLP

(57) ABSTRACT

The present invention provides an electric resistance welded steel pipe for a hollow stabilizer excellent in workability, which steel pipe contains, in mass, 0.20 to 0.35% of C, 0.10 to 0.50% of Si, 0.30 to 1.00% of Mn, 0.01 to 0.10% of Al, 0.10 to 1.00% of Cr, 0.005 to 1.00% of Mo, 0.001 to 0.02% of Ti, 0.0005 to 0.0050% of B and 0.0010 to 0.0100% of N, satisfying the expression N/14<Ti/47.9, the balance consisting of Fe and unavoidable impurities and further has an ideal critical diameter (Di) being 1.0 (in) or more, an n-value in the axial direction of the steel pipe being 0.12 or more, a difference in hardness between the electric resistance welded seam portion and the base steel being Hv 30 or less, an average grain size of ferrite being 3 to 40 μm, an area percentage of the ferritic crystal grains having the aspect ratios of 0.5 to 3.0 being 90% or more in the entire ferrite phase, and having an average grain size of 20 μm or less in the second phase.

8 Claims, No Drawings

ELECTRIC RESISTANCE-WELDED STEEL PIPE FOR HOLLOW STABILIZER

TECHNICAL FIELD

The present invention relates to an electric resistance welded steel pipe suitable for a hollow stabilizer, for securing the running stability of a car, having a homogeneous metallographic structure and being hard in a welded portion including a butt welded joint portion and heat affected zones and in a base steel not included in the welded portion, and being excellent in workability.

BACKGROUND ART

The weight reduction of a car body has been promoted as a measure to improve the fuel consumption of a car. A stabilizer for suppressing the rolling of a car body during cornering and thus securing the running stability of the car body during high speed running is also one of the subjects of weight reduction. A conventional stabilizer was usually a solid bar manufactured by machining a steel bar into the shape of an end product, but a steel pipe, which is a hollow material such as a seamless steel pipe or an electric resistance welded steel pipe, is often used for the manufacture of a stabilizer for promoting weight reduction.

Improved workability and the soundness of a welded portion are required of a material used for the manufacture of a stabilizer, as the material is formed into a complicated shape or undergoes working such as compression bonding of the ends. In addition, good hardenability must be secured in a heat treatment applied for obtaining high fatigue strength.

The chemical compositions of electric resistance welded steel pipes for hollow stabilizers are described in Japanese Examined Patent Publication Nos. H1-58264 and S61-45688. However, the publications do not describe the regulation of Mo, which is an important element for improving hardenability, and thus the steel pipes based on the publications are unsuitable for securing good hardenability during a heat treatment. In addition, the publications do not specify the quantitative limitations of the contents of N and O, and therefore the control of toughness and oxides in steel is insufficient. Further, none of the publications include descriptions regarding metallographic structure, n-value and hardness, and it is difficult to enhance workability without controlling these items.

A steel pipe of an alloy steel for structural use and a steel pipe of a carbon steel for machine structural use or the like are also used as material pipes for hollow stabilizers in which properties such as workability, the soundness of the welded portion and hardenability are required. However, a steel pipe of an alloy steel for structural use has a problem in the bend formability of the material pipe and a steel pipe of a steel for machine structural use has a problem in hardenability.

DISCLOSURE OF THE INVENTION

The object of the present invention is to provide a new electric resistance welded steel pipe having properties suitable for a hollow stabilizer for solving the problems in the manufacture of the stabilizer as delineated above.

The gist of the present invention for solving said problems is as follows:

(1) An electric resistance welded steel pipe for a hollow stabilizer, characterized by: containing, in mass, 0.20 to 0.35% of C,
0.10 to 0.50% of Si,
0.30 to 1.00% of Mn,
0.01 to 0.10% of Al,
0.10 to 1.00% of Cr,
0.005 to 1.00% of Mo,
0.001 to 0.02% of Ti,
0.0005 to 0.0050% of B and
0.0010 to 0.0100% of N;

satisfying the expression $N/14<Ti/47.9$; and having the balance consisting of Fe and unavoidable impurities.

(2) An electric resistance welded steel pipe for a hollow stabilizer according to the item (1), further characterized in that the ideal critical diameter Di defined by the expression below is 1.0 (in) or more:

$$Di=(0.06+0.4\times\%\ C)\times(1+0.64\times\%\ Si)\times(1+4.1\times\%\ Mn)\times(1+2.33\times\%\ Cr)\times(1+3.14\times\%\ Mo)\times\{1+1.5\times(0.9-\%\ C)\times\%\ B^2\}.$$

(3) An electric resistance welded steel pipe for a hollow stabilizer according to the item (1) or (2), further characterized by controlling the contents, in mass, of P, S and O as follows:

0.030% or less for P,
0.020% or less for S and
0.015% or less for O.

(4) An electric resistance welded steel pipe for a hollow stabilizer according to any one of the items (1) to (3), further characterized in that the n-value in the axial direction of the steel pipe is 0.12 or more.

(5) An electric resistance welded steel pipe for a hollow stabilizer according to any one of the items (1) to (4), characterized in that the difference in hardness between the electric resistance welded seam portion and the base steel is Hv 30 or less.

(6) An electric resistance welded steel pipe for a hollow stabilizer according to any one of the items (1) to (5), further characterized in that the average grain size of ferrite is 3 to 40 μm.

(7) An electric resistance welded steel pipe for a hollow stabilizer according to any one of the items (1) to (6), characterized in that the area percentage of the ferritic crystal grains having the aspect ratios of 0.5 to 3.0 is 90% or more in the entire ferrite phase.

(8) An electric resistance welded steel pipe for a hollow stabilizer according to any one of the items (1) to (7), further characterized by having an average grain size of 20 μm or less in the second phase.

BEST MODE FOR CARRYING OUT THE INVENTION

A hot-rolled steel sheet having a specific chemical composition is used as a raw material in the present invention, but the means of producing the hot-rolled material is not limited in particular. Besides, the present invention is satisfactorily applicable to any electric resistance welded steel pipe produced by either cold forming or hot forming while employing an electric resistance welding method using high frequency electric current.

In the first place, the chemical composition of a steel pipe is explained.

C is an element which dissolves in the state of a solid solution or precipitates in the form of carbides in a base steel, and increases steel strength. It also precipitates in the form of a hard second phase such as cementite, pearlite, bainite or martensite and contributes to the enhancement of steel strength and uniform elongation. 0.20% or more of C is required for increasing steel strength but, when its content exceeds 0.35%, workability and weldability are deteriorated. For this reason, the content of C is limited to the range from 0.20 to 0.35%.

Si is a solid solution hardening element and 0.10% or more of Si is necessary for securing strength. However, when its content exceeds 0.50%, Si—Mn system inclusions, which constitute weld defects, are likely to form during electric resistance seam welding, adversely affecting the soundness of the electric resistance welded portion. The content of Si is, therefore, limited to the range from 0.10 to 0.50%. Preferably, the Si content is within the range from 0.10 to 0.30%.

Mn is an element for enhancing steel strength and hardenability but, when its content is below 0.30%, sufficient strength cannot be obtained in quenching. On the other hand, when the content exceeds 1.00%, weldability and the soundness of the welded portion are adversely affected. The content of Mn is, therefore, limited to the range from 0.30 to 1.00%.

Al is an indispensable element which is used as an agent for deoxidizing molten steel and is also an element which fixes N and, hence, its content has a significant influence on the size of crystal grains and the mechanical properties of a steel. An Al content of 0.01% or more is required for achieving these effects but, when its content exceeds 0.10%, non-metallic inclusions form in quantities and surface defects are likely to appear in the final product. For this reason, the content of Al is limited to the range from 0.01 to 0.10%.

Cr is an element for improving hardenability and has the effects of making $M_{23}C_6$ type carbides precipitate in the matrix and thus raising the strength and making the carbides finer. When the content of Cr is below 0.10%, these effects are not expected to show sufficiently. On the other hand, when the content exceeds 1.0%, penetrators are likely to form during welding. For this reason, the content of Cr is limited to the range from 0.10 to 1.0%.

Mo is an element which improves hardenability, and hardens the steel at solid solution and stabilizes the $M_{23}C_6$ type carbides. When its content is below 0.005%, these effects do not appear sufficiently. On the other hand, when its content is in excess of 1.00%, coarse carbides precipitate easily, deteriorating the toughness. For this reason, the content of Mo is limited to the range from 0.005 to 1.0%.

Ti works for stably and effectively enhancing the hardenability obtained by the addition of B. When its content is below 0.001%, however, a tangible effect is not expected. On the other hand, when the content is in excess of 0.02%, toughness tends to deteriorate. For this reason, the content of Ti is limited to the range from 0.001 to 0.02%. Preferably, its content is to be within the range where the expression $N/14<Ti/47.9$ is satisfied.

B is an element for significantly enhancing the hardenability of a steel material with addition in a small quantity, and it also has the effects of strengthening grain boundaries and enhancing precipitation hardening by forming compounds such as $M_{23}(C, B)_6$. When its addition amount is below 0.0005%, no effect of enhancing the hardenability is expected. On the other hand, when added in excess of 0.0050%, a coarse phase containing B tends to form and, besides, embrittlement is likely to take place. For this reason, the content of B is limited to the range from 0.0005 to 0.0050%.

N is one of the important elements in making nitrides or carbonitrides precipitate and thus enhancing steel strength. The effect appears when N is added at 0.0010% or more but, when added in excess of 0.01%, toughness tends to deteriorate due to the coarsening of nitrides and the age-hardening by solute N. For this reason, its content is limited to the range from 0.0010 to 0.0100%.

P is an element which adversely affects weld crack resistance and toughness and therefore its content is limited to 0.030% or less. Preferably, its content is 0.020% or less.

S has an influence on non-metallic inclusions in a steel, deteriorates the bending and flattening properties of a steel pipe, and causes toughness to deteriorate and anisotropy and reheating crack susceptibility to increase. It also influences the soundness of a welded portion. For this reason, the content of S is limited to 0.020% or less. Preferably, its content is to be 0.010%.

O not only causes the formation of oxides which adversely affect toughness but also forms oxides which trigger fatigue fracture, deteriorating fatigue resistance. For this reason, the upper limit of its content is set at 0.015%.

The ideal critical diameter Di (in) defined by the expression below influences the quench hardness after a steel pipe is worked into a hollow stabilizer. When the value of Di is below 1.0 (in), required hardness is not obtained and, therefore, the lower limit of its value is set at 1.0 (in).

$$Di=(0.06+0.4\times\%\ C)\times(1+0.64\times\%\ Si)\times(1+4.1\times\%\ Mn)\times(1+2.33\times\%\ Cr)\times(1+3.14\times\%\ Mo)\times\{1+1.5\times(0.9-\%\ C)\times\%\ B^2\}$$

Further, in the working of a steel pipe, when the n-value in the axial direction is below 0.12, the remarkable improvement of workability is not obtained. Therefore, the n-value is preferably limited to 0.12 or higher. More preferably, the value is 0.15 or higher.

Stress concentration, which causes fatigue fracture, is likely to occur in the softened portion caused by welding and the hardened portion of weld heat affected zones. Therefore, homogenizing the hardness in the circumferential direction of a steel pipe is one effective measure for improving fatigue resistance. When the difference between the maximum hardness and the minimum hardness of the base material and the electric resistance welded seam portion including the weld heat affected zones is preferably 30 Hv or less, the stress concentration is alleviated and fatigue resistance is improved.

Next, the metallographic structure of a steel pipe product is explained.

Metallographic observations of the ferrite phase and the second phase of a steel pipe according to the present invention were carried out using an optical microscope and a scanning electron microscope on a polished section surface parallel to the longitudinal direction of the steel pipe after buffing the section surface and then etching it with nital. Note that the second phase grains having sizes below 0.5 μm were not counted in the calculation of the average size.

When the average grain size of the ferrite phase at a section parallel to the longitudinal direction of a steel pipe is below 3 μm, uniform elongation is deteriorated and, when it exceeds 45 μm, the uniform elongation is not expected to improve any more and, thus, a remarkable improvement of workability is not obtained. For this reason, the range of the average grain size of the ferrite phase is defined to be from 3 to 45 μm. Preferably, the average size is within the range from 3 to 20 μm.

When an aspect ratio, which is the ratio of the long side to the short side of a ferrite phase, at a section surface parallel to the longitudinal direction of a steel pipe is below 0.5 or above 3.0, the elongation of the steel pipe becomes uneven in the axial, circumferential and wall thickness directions, the effect of enhancing ductility is reduced and, thus, it becomes impossible to obtain the remarkable improvement of workability. For this reason, the aspect ratio of the long side to the short side is limited to the range from 0.5 to 3.0. Preferably, the aspect ratio of the long side to the short side is to be within the range from 0.5 to 2.0.

Further, when the area percentage of the crystal grains having the aspect ratios, each of which is the ratio of the long side to the short side of the ferrite phase, of 0.5 to 3.0 is below 86%, the effect of enhancing ductility is reduced and it becomes impossible to obtain the remarkable improvement of workability. For this reason, the area percentage of the crystal grains having the aspect ratios of the long side to the short side of 0.5 to 3.0 is limited to 86% or more.

When the average size of the second phase at a section surface parallel to the longitudinal direction of a steel pipe exceeds 20 μm, the improvement of uniform elongation cannot be expected and thus the remarkable improvement of workability is not obtained. For this reason, the average size of the second phase is preferably limited to 20 μm or less. More preferably, the average size of the second phase is to be 10 μm or less and it is to be equal to the average ferritic grain size or smaller.

EXAMPLE

The steels having the chemical compositions listed in Table 1 were melted and cast into slabs. The slabs were then heated to 1,150° C. and hot-rolled into the steel sheets 6.5 mm in thickness at a finish rolling temperature of 890° C. and a coiling temperature of 630° C. The hot-rolled steel sheets thus obtained were slit and then formed into steel pipes 89.1 mm in outer diameter by high frequency induction seam welding. The original steel pipes were subsequently heated to 980° C. by high frequency induction heating and then subjected to diameter reduction rolling to obtain product steel pipes 28 mm in diameter and 7.5 mm in wall thickness.

Besides the above, using the original steel pipes of the steel of the reference symbol N in Table 1, product steel pipes 25 mm in diameter and 6.0 mm in wall thickness were produced through diameter reduction rolling under different conditions, and the n-value, hardness and metallographic structure of each of the steel pipes thus obtained were evaluated. The results are shown in Table 2.

The n-value was measured through a tensile test of each of the product pipes thus obtained. The workability was evaluated through a flaring test, a 90°-2D bend test and an end flattening test, and the samples showing no cracks in the welded seam portions were evaluated as good in workability. The hardness distribution in each of the base steels and the welded seam portions including heat affected zones was also measured and the samples showing hardness difference ΔHv of 30 or less were evaluated as good.

In the inventive examples (reference symbols B, E, H, K, N, Q and S) shown in Table 1, which fell within the ranges of the present invention, the desired range of the ideal critical diameter was satisfied and no cracks occurred at the bend test and end flattening test. In contrast, in comparative examples, which fell outside the ranges of the present invention, workability was poor as described below.

In the comparative examples (reference symbols A, D, G, J, M and P), the contents of the elements necessary for securing hardenability were insufficient and the desired range of the ideal critical diameter was not satisfied. In the comparative example of reference symbol C, workability was low because the C content exceeded the prescribed range according to the present invention and, thus, cracks occurred in the bend test and in the end flattening test. The Si content in the comparative example of reference symbol F and the Mn content in the comparative example of reference symbol R were above the respective ranges specified in the present invention and, consequently, Si—Mn inclusions formed during the seam welding, the workability of the welded joint was lowered and, as a result, cracks occurred in the bend test and in the end flattening test.

In the comparative example of reference symbol L, the content of Cr was above the prescribed range according to the present invention and, consequently, a many of penetrators occurred during the seam welding and, as a result, cracks occurred in the bend test and in the end flattening test. In the comparative example of reference symbol T, the content of O was above the prescribed range according to the present invention and, consequently, oxides formed in large quantities and, as a result, cracks occurred in the bend test and in the end flattening test. In the comparative example of reference symbol I, the content of Ti was above the prescribed range according to the present invention and, consequently, the toughness deteriorated and, as a result, cracks occurred in the end flattening test. In the comparative example of reference symbol O, the content of Mo was above the prescribed range according to the present invention and, consequently, coarse carbides formed in large quantities and, as a result, cracks occurred in the bend test and in the end flattening test.

For reference, in the inventive examples shown in Table 1, the n-value was 0.10 to 0.11, the difference in hardness was Hv 32, the average grain size of ferrite was 41 to 45 μm, the area percentage of the ferritic crystal grains having the aspect ratios of 0.5 to 3.0 was 86 to 89% in the entire ferrite phase, and the average size of the second phase was 21 to 25 μm.

In the comparative examples shown in Table 2, which fell outside the ranges of the present invention, workability was poor as described below.

In comparative example No. 1, workability was low because the n-value was low and, as a result, cracks occurred in the end flattening test. In comparative example No. 3, workability was low because the difference in hardness was as high as Hv 51 and, as a result, cracks occurred in the end flattening test. In comparative example No. 5, uniform elongation was low because the average grain size of ferrite was as small as 1 μm and, as a result, cracks occurred in the end flattening test. In comparative example No. 7, the average grain size of ferrite was as large as 50 μm, the workability at the grain boundaries with the second phase was low and, besides, the difference in hardness was high, and, as a result, cracks occurred in the bend test and in the end flattening test.

In comparative example No. 8, workability was low because the area percentage of the ferritic crystal grains having the aspect ratios of 0.5 to 3.0 was as low as 75% in the entire ferrite phase and n-value was as low as 0.09, and, as a result, cracks occurred in the end flattening test. In comparative example No. 10, the average size of the second phase was as large as 45 μm and the difference in hardness was Hv 37 and, as a result, cracks occurred in the bend test and in the end flattening test.

In contrast, in inventive examples (Nos. 2, 4, 6, 9 and 11), no cracks occurred in either the bend test or in the end flattening test.

TABLE 1

| Reference symbol | Chemical composition (mass %) | | | | | | | | | | | |
|---|---|---|---|---|---|---|---|---|---|---|---|---|
| No. | C | Si | Mn | P | S | Al | Cr | Mo | B | Ti | N | O |
| A | *0.08 | 0.30 | 0.75 | 0.034 | 0.024 | 0.020 | 0.12 | 0.010 | *0.0001 | 0.011 | 0.0035 | 0.0165 |
| B | 0.22 | 0.35 | 0.75 | 0.032 | 0.023 | 0.017 | 0.12 | 0.011 | 0.0015 | 0.012 | 0.0021 | 0.0153 |
| C | *0.51 | 0.34 | 0.75 | 0.035 | 0.023 | *0.124 | 0.12 | 0.010 | 0.0018 | 0.011 | 0.0019 | 0.0169 |
| D | 0.22 | *0.05 | 0.41 | 0.033 | 0.025 | 0.022 | 0.50 | 0.01 | *0.0092 | 0.012 | 0.0023 | 0.0167 |
| E | 0.26 | 0.39 | 0.45 | 0.033 | 0.022 | 0.025 | 0.52 | 0.02 | 0.0020 | 0.011 | 0.0020 | 0.0154 |
| F | 0.25 | *0.86 | 0.43 | 0.033 | 0.024 | 0.020 | 0.51 | 0.02 | 0.0021 | 0.013 | *0.0212 | 0.0188 |
| G | 0.21 | 0.12 | 0.31 | 0.011 | 0.006 | 0.024 | 0.70 | 0.008 | 0.0032 | *0.0006 | *0.0005 | 0.0088 |
| H | 0.23 | 0.13 | 0.33 | 0.012 | 0.007 | 0.023 | 0.75 | 0.008 | 0.0038 | 0.010 | 0.0017 | 0.0090 |
| I | 0.22 | 0.14 | 0.33 | 0.011 | 0.007 | 0.026 | 0.74 | 0.009 | 0.0035 | *0.127 | 0.0020 | 0.0092 |
| J | 0.24 | 0.20 | 0.50 | 0.009 | 0.009 | 0.032 | *0.01 | 0.20 | 0.0040 | 0.012 | 0.0023 | 0.0080 |
| K | 0.25 | 0.23 | 0.56 | 0.008 | 0.008 | 0.030 | 0.35 | 0.20 | 0.0035 | 0.013 | 0.0021 | 0.0078 |
| L | 0.25 | 0.22 | 0.52 | 0.009 | 0.008 | 0.035 | *1.31 | 0.20 | *0.0021 | 0.011 | 0.0019 | 0.0072 |
| M | 0.24 | 0.15 | 0.47 | 0.010 | 0.012 | 0.028 | 0.33 | *0.001 | 0.0020 | 0.012 | 0.0017 | 0.0090 |
| N | 0.23 | 0.19 | 0.49 | 0.011 | 0.012 | 0.028 | 0.35 | 0.23 | 0.0022 | 0.014 | 0.0019 | 0.0087 |
| O | 0.23 | 0.17 | 0.45 | 0.010 | 0.013 | *0.005 | 0.34 | *1.22 | 0.0021 | 0.013 | 0.0022 | 0.0080 |
| P | 0.22 | 0.41 | *0.11 | 0.012 | 0.008 | 0.020 | 0.30 | 0.30 | 0.0009 | 0.012 | 0.0020 | 0.0074 |
| Q | 0.23 | 0.45 | 0.54 | 0.012 | 0.008 | 0.016 | 0.35 | 0.33 | 0.0010 | 0.018 | 0.0021 | 0.0082 |
| R | 0.23 | 0.44 | *1.63 | 0.011 | 0.007 | 0.018 | 0.31 | 0.32 | 0.0008 | 0.016 | 0.0025 | 0.0094 |
| S | 0.23 | 0.18 | 0.52 | 0.013 | 0.006 | 0.025 | 0.35 | 0.12 | 0.0011 | 0.015 | 0.0032 | 0.0076 |
| T | 0.21 | 0.19 | 0.53 | 0.012 | 0.010 | 0.021 | 0.34 | 0.11 | 0.0012 | 0.016 | 0.0021 | *0.0182 |

| Reference symbol | Chemical composition (mass %) Expression N/14 < Ti/47.9 | | Ideal critical diameter Di | Workability | | | | |
|---|---|---|---|---|---|---|---|---|
| | | | | Flaring test $D/D_0$ | Bend test 90° | End flattening test | | |
| No. | M/14 | Ti/47.9 | (in) | (%) | −2D | H = 4t | Remarks | Claim |
| A | 0.0003 | **0.0002 | 0.59 | 1.2 | Æ | X | Comparative example | |
| B | 0.0002 | 0.0003 | 0.98 | 1.4 | Æ | Æ | Inventive example | 1 |
| C | 0.0001 | 0.0002 | 1.73 | 1.1 | X | X | Comparative example | |
| D | 0.0002 | 0.0003 | 0.91 | 1.2 | Æ | Æ | Comparative example | |
| E | 0.0001 | 0.0002 | 1.23 | 1.4 | Æ | Æ | Inventive example | 2 |
| F | 0.0015 | **0.0003 | 1.59 | 1.1 | X | X | Comparative example | |
| G | 0.00004 | **0.00001 | 0.95 | 1.3 | Æ | X | Comparative example | |
| H | 0.0001 | 0.0002 | 1.09 | 1.5 | Æ | Æ | Inventive example | 3 |
| I | 0.0001 | **0.0027 | 1.06 | 1.1 | Æ | X | Comparative example | |
| J | 0.0002 | 0.0003 | 0.89 | 1.4 | Æ | X | Comparative example | |
| K | 0.0002 | 0.0003 | 1.79 | 1.5 | Æ | Æ | Inventive example | 3 |
| L | 0.0001 | 0.0002 | 3.77 | 1.1 | X | X | Comparative example | |
| M | 0.0001 | 0.0003 | 0.89 | 1.3 | Æ | X | Comparative example | |
| N | 0.0001 | 0.0003 | 1.60 | 1.5 | Æ | Æ | Inventive example | 3 |
| O | 0.0002 | 0.0003 | 4.15 | 1.1 | X | X | Comparative example | |
| P | 0.0001 | 0.0002 | 0.89 | 1.4 | Æ | Æ | Comparative example | |
| Q | 0.0002 | 0.0004 | 2.23 | 1.6 | Æ | Æ | Inventive example | 3 |
| R | 0.0002 | 0.0003 | 5.17 | 1.1 | X | X | Comparative example | |
| S | 0.0002 | 0.0003 | 1.33 | 1.5 | Æ | Æ | Inventive example | 3 |

TABLE 1-continued

| | | | | | | | |
|---|---|---|---|---|---|---|---|
| T | 0.0002 | 0.0003 | 1.24 | 1.1 | X | X | Comparative example |

*Outside ranges in claims of this invention
**Not satisfying expression N/14 < Ti/47.9

TABLE 2

| | | | Metallographic structure | | | Workability | | | | |
|---|---|---|---|---|---|---|---|---|---|---|
| | | | Ferrite phase | | Second | | | | | |
| No. | n-value | Hardness Difference in hardness (Hv) | Average grain size (μm) | Area percentage** (%) | phase Average size (μm) | Flaring test $D/D_0$ (%) | Bend test 90° −2D | End flattening test H = 4t | Remarks | Claim |
| 1 | *0.07 | 42 | 50 | 80 | 40 | 1.2 | E | X | Comparative example | |
| 2 | 0.21 | 34 | 43 | 88 | 35 | 1.7 | E | E | Inventive example | 4 |
| 3 | 0.12 | *51 | 48 | 82 | 37 | 1.2 | E | X | Comparative example | |
| 4 | 0.22 | 19 | 42 | 87 | 34 | 1.7 | E | E | Inventive example | 5 |
| 5 | *0.10 | 25 | *1 | 75 | 1 | 1.2 | E | X | Comparative example | |
| 6 | 0.20 | 20 | 8 | 88 | 22 | 1.8 | E | E | Inventive example | 6 |
| 7 | 0.12 | *49 | *50 | 88 | 51 | 1.1 | X | X | Comparative example | |
| 8 | *0.09 | 26 | 9 | *75 | 23 | 1.3 | E | X | Comparative example | |
| 9 | 0.20 | 20 | 8 | 95 | 24 | 1.8 | E | E | Inventive example | 7 |
| 10 | 0.12 | *37 | 15 | 91 | *45 | 1.1 | X | X | Comparative example | |
| 11 | 0.21 | 16 | 12 | 94 | 3 | 1.8 | E | E | Inventive example | 8 |

*Outside ranges in claims of this invention
Area percentage**: Area percentage of ferritic crystal grains having aspect ratios of 0.5 to 3.0 in entire ferrite phase

INDUSTRIAL APPLICABILITY

An electric resistance welded steel pipe for a hollow stabilizer according to the present invention has a homogeneous metallographic structure in the electric resistance welded seam portion and the base steel, a small difference in hardness between the electric resistance welded seam portion and the base steel, and excellent workability and, as a result, it is capable of contributing to reducing car body weight and simplifying manufacturing processes.

The invention claimed is:

1. An electric resistance welded steel pipe for a hollow stabilizer characterized by: containing, in mass, 0.20 to 0.35% of C,
0.10 to 0.50% of Si,
0.30 to 1.00% of Mn,
0.01 to 0.10% of Al,
0.10 to 1.00% of Cr,
0.005 to 1.00% of Mo,
0.001 to 0.02% of Ti,
0.0005 to 0.0050% of B and
0.0010 to 0.0100% of N;

satisfying the expression N/14<Ti/47.9; and having the balance consisting of Fe and unavoidable impurities, and the welded steel pipe further has a ferrite phase, an average ferrite grain size of 3 to 45 μm, and an area percentage of ferrite crystal grains having an aspect ratio of 0.5 to 3.0 is 86% or more in the entire ferrite phase.

2. An electric resistance welded steel pipe for a hollow stabilizer according to claim 1, further characterized in that the ideal critical diameter Di defined by the expression below is 1.0 (in) or more:

$$Di=(0.06+0.4\times\%\ C)\times(1+0.64\times\%\ Si)\times(1+4.1\times\%\ Mn)\times(1+2.33\times\%\ Cr)\times(1+3.14\times\%\ Mo)\times\{1+1.5\times(0.9-\%\ C)\times\%\ B^2\}.$$

3. An electric resistance welded steel pipe for a hollow stabilizer according to claim 1, further characterized by controlling the contents, in mass, of P, S and O as follows:

0.030% or less for P, 0.020% or less for S and 0.015% or less for O.

4. An electric resistance welded steel pipe for a hollow stabilizer according to claim 1, further characterized in that the n-value in the axial direction of the steel pipe is 0.12 or more.

5. An electric resistance welded steel pipe for a hollow stabilizer according to claim, 1, characterized in that the difference in hardness between the electric resistance welded seam portion and the base steel is Hv 30 or less.

6. An electric resistance welded steel pipe for a hollow stabilizer according to claim 1, further characterized in that the average grain size of ferrite is 3to 40 μm.

7. An electric resistance welded steel pipe for a hollow stabilizer according to claim 1, characterized in that the area percentage of the ferritic crystal grains having the aspect ratios of 0.5 to 3.0 is 90% or more in the entire ferrite phase.

8. An electric resistance welded steel pipe for a hollow stabilizer according to claim 1, further characterized by having an average grain size of 20 μm or less in a second phase.

* * * * *